US006308448B1

(12) United States Patent
Kapusta et al.

(10) Patent No.: US 6,308,448 B1
(45) Date of Patent: Oct. 30, 2001

(54) ANGLED INTERLOCKED FIRING MECHANISM

(75) Inventors: John Kapusta, Belchertown; John Pliska, Granby, both of MA (US)

(73) Assignee: Smith & Wesson Corporation, Springfield, MA (US)

( * ) Notice: Subject to any disclaimer, the term of this patent is extended or adjusted under 35 U.S.C. 154(b) by 0 days.

(21) Appl. No.: 09/303,210

(22) Filed: Apr. 30, 1999

(51) Int. Cl.[7] ..... F41A 3/00
(52) U.S. Cl. ..... 42/69.02
(58) Field of Search ..... 42/69.02

(56) References Cited

U.S. PATENT DOCUMENTS

| | | | | |
|---|---|---|---|---|
| 3,857,325 | | 12/1974 | Thomas | 89/138 |
| 4,411,087 | * | 10/1983 | Aikman | 42/69.02 |
| 4,539,889 | | 9/1985 | Glock | 89/147 |
| 4,646,619 | * | 3/1987 | Sokolovsky | 89/145 |
| 4,671,005 | * | 6/1987 | Jewell | 42/69.02 |
| 4,825,744 | * | 5/1989 | Glock | 89/145 |
| 4,893,546 | | 1/1990 | Glock | 89/145 |
| 4,908,970 | * | 3/1990 | Bell | 42/69.02 |
| 5,157,209 | | 10/1992 | Dunn | 42/70.08 |
| 5,386,659 | | 2/1995 | Vaid et al. | 42/69.02 |
| 5,402,593 | | 4/1995 | Lenkarski et al. | 42/70.06 |
| 5,640,794 | * | 6/1997 | Gardner et al. | 42/69.02 |

* cited by examiner

*Primary Examiner*—Michael J. Carone
*Assistant Examiner*—Denise J Buckley
(74) *Attorney, Agent, or Firm*—McCormick, Paulding & Huber LLP

(57) ABSTRACT

An interlocked firing mechanism for a gun includes a trigger, a sear and a firing pin having a depending leg, wherein the firing pin is movable in a rectilinear manner along a firing axis. The depending leg of the firing pin is adapted to have a contact surface, while the sear is adapted to have a control surface in mating engagement with the contact surface at a time prior to firing of the gun. The contact surface and the control surface of the interlocked firing mechanism of the present invention are further adapted to have parallel surfaces which mate with one another along a mating axis, defining an edge of a mating plane, which is set at a predetermined angle from a line perpendicular to the firing axis.

6 Claims, 8 Drawing Sheets

ANGLED INTERLOCKED FIRING MECHANISM

FIELD OF THE INVENTION

This invention relates generally to an interlocked firing mechanism of a semiautomatic handgun, and more particularly to an angled, interlocked firing mechanism of a semiautomatic handgun which reduces the possibility of accidental discharge, or no discharge at all, of a round of ammunition caused by override of a firing pin.

BACKGROUND OF THE INVENTION

One type of fire control mechanism commonly used in semiautomatic handguns includes a hammer which is pivotable from a rearward cocked position to a forward position for impacting the firing pin. A sear releasably retains the hammer in its cocked position with the hammer spring or main spring in compression. When the trigger is actuated, the sear is moved to release the hammer that is moved by the stored energy of the main spring, to strike the firing pin which is thereby driven forward to fire a chambered round. The principal drawback of this type of mechanism is that it includes numerous parts and is relatively complex and expensive to manufacture.

Another common configuration is disclosed in U.S. Pat. No. 3,857,325 to Thomas wherein a striker type firing pin is utilized in lieu of a pivotable hammer. Upon actuation of the trigger, a trigger bar operated sear engages a projection that extends from the firing pin and moves the firing pin rearward, thereby to compress a firing pin spring. When the trigger is moved a predetermined distance rearward, the sear will be moved to release the firing pin projection whereby the firing pin spring will drive the firing pin in a forward direction with sufficient force to fire a chambered round.

This mechanism has at least one principal disadvantage in that there is no provision for disconnecting the sear from the trigger to allow the sear to move independently back into the path of the firing pin during the recoil of the slide. The absence of this feature makes for a gun having a relatively low rate of fire. In addition, this mechanism may be difficult to manufacture and its components subject to fatigue and failure with extensive usage.

Other configurations which utilize firing pin striker mechanisms include those disclosed in U.S. Pat. Nos. 4,539,889; 4,825,744 and 4,893,546 issued to Glock. In all but one of the configurations of the above referenced patents, which discloses a hammer for engaging the firing pin, an abutment is provided to alternately engage and disengage the nose of a firing pin. When the trigger is actuated, the abutment engages the downwardly depending nose of the firing pin and moves the same rearwardly until the nose and the abutment have reached a predetermined position. With the firing pin at that position, the spring will have been compressed and various control or camming means are disclosed for moving the abutment out of the path of the firing pin nose whereby the firing pin spring will impel the firing pin with sufficient force to fire a chambered round.

One of the principal characteristics of such prior art handguns is that, due to the recoil forces and machining tolerances of the handguns, the firing mechanism may not perform in the manner intended. In certain cases the handgun may have either repeated firings stemming from a single activation of the trigger, while in other cases, the handgun may not fire at all upon subsequent activation of the trigger.

Such handguns can therefore be said to have a measured amount of firing uncertainty, this uncertainty increasing as the wear on the constituent elements of the handgun increases.

SUMMARY OF THE INVENTION

It is therefore a major aspect of the present invention to have an interlocked firing mechanism which reduces the possibility of either unintended discharge, or no discharge at all, when a handgun is operated.

It is another major aspect of the present invention to have an interlocked firing mechanism which reduces the possibility of either unintended discharge or no discharge of a handgun in a manner which requires minimal re-engineering of a handgun, including taking into consideration machining tolerances and the effect of the recoil force on the handgun.

It is another major aspect of the present invention to have an interlocked firing mechanism which reduces the possibility of either unintended discharge or no discharge of a handgun without altering the design shape of either a cam or a cam surface controlling firing of the handgun.

It is another major aspect of the present invention to have an interlocked firing mechanism which reduces the possibility of either unintended discharge or no discharge of a handgun even after operational wear of constituent elements occurs through repeated use of a handgun.

It is another major aspect of the present invention to have an interlocked firing mechanism which provides for consistent engagement, and therefore consistent disengagement, of a firing pin of a handgun.

It is another major aspect of the present invention to have an interlocked firing mechanism which can accommodate greater variations in machining tolerances without compromising operational safety or functioning, thereby lowering manufacturing costs.

According to one embodiment of the present invention an interlocked firing mechanism for a gun includes a trigger, a sear and a firing pin having a depending leg, wherein the firing pin is movable in a rectilinear manner along a firing axis. The depending leg of the firing pin is adapted to have a contact surface while the sear is adapted to have a control surface in mating engagement with the contact surface at a time prior to firing of the gun.

The contact surface and the control surface of the interlocked firing mechanism of the present invention are further adapted to have parallel surfaces which mate with one another along a mating axis, defining an edge of a mating plane, which is set at a predetermined angle from a line perpendicular to the firing axis.

The predetermined angle is oriented so as to be preferably between approximately 5° to approximately 25°, and more preferably is approximately 15°.

DETAILED DESCRIPTION OF THE PREFERRED EMBODIMENT

Figure 1:
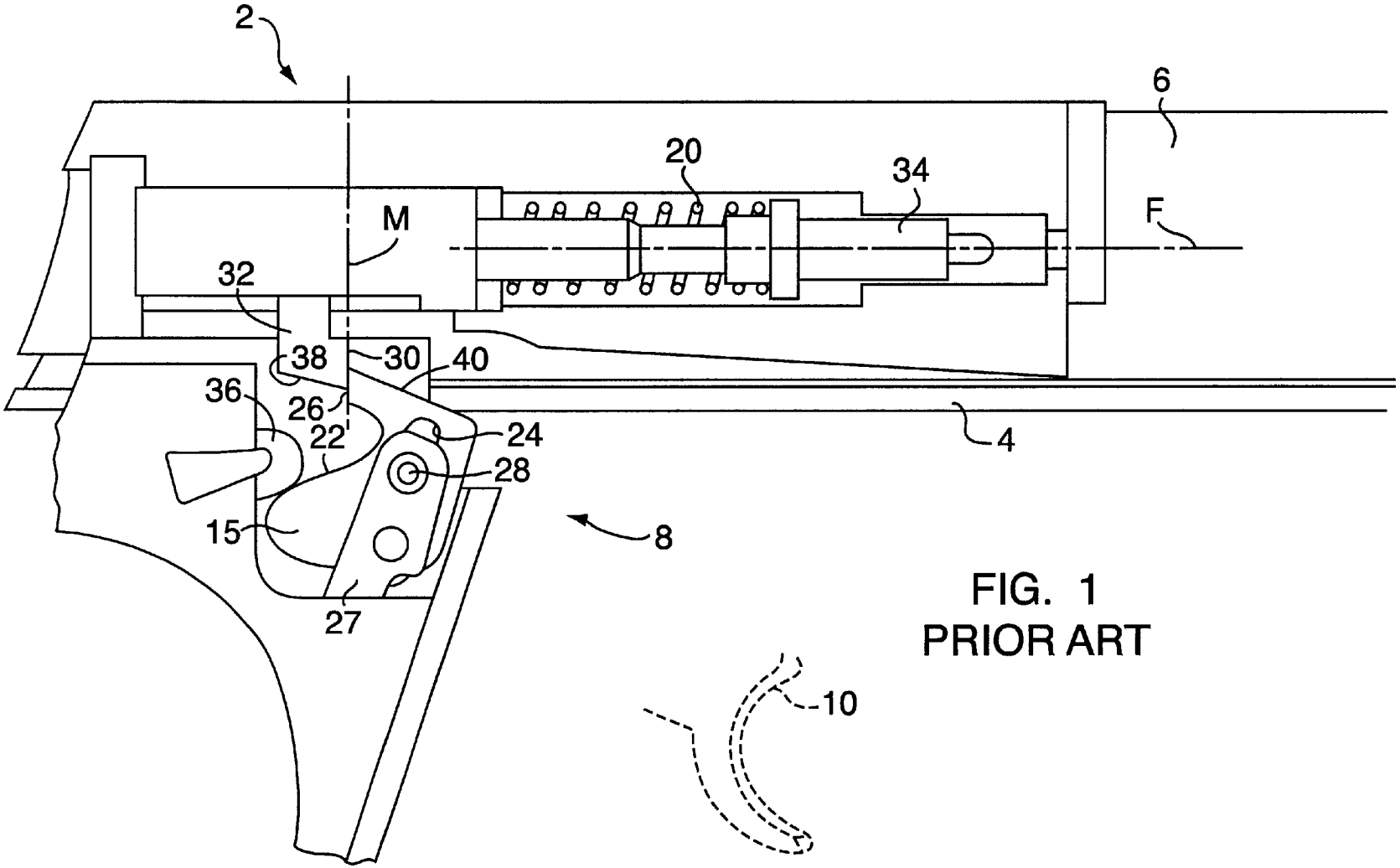
FIG. 1 PRIOR ART
FIG. 1 is a partial cross-sectional view of a prior art semiautomatic handgun of the type employing a non-angled interface between a sear and a depending leg of a firing pin.

Referring to FIG. 1, a semiautomatic pistol or handgun 2 is shown embodying a prior art arrangement and generally comprises a high impact polymeric or metalized frame 4, a slide 6 and a firing mechanism, designated generally by numeral 8.

The firing mechanism 8 generally comprises a trigger 10 that pivots to initiate the firing of a round of ammunition from the handgun 2. The trigger 10 may be of unitary construction, as shown, or of a two-piece articulated construction. In either case, when one actuates the trigger 10 it will rotate and move rearward about a pivot point and, in a manner well known in the art, move a sear 15 sufficiently to cause the release of a firing spring 20 and thereby cause the gun 2 to be fired, as will hereinafter be described in greater detail. Upon firing, recoil of the handgun 2 will enable repositioning of a firing pin 34 which will once again engage the sear 15 at a forward or "ready" position for the next firing cycle, a position as illustrated in FIG. 1. It will be readily apparent that the interconnections between the trigger 10 and the sear 15 during operation of the handgun 2 can be arranged in one of any number of conventional fashions, the particular arrangement of these interconnections not being of primary concern with respect to the present invention. Two examples of known interconnections between a trigger member and a sear can be found in commonly assigned U.S. Pat. No. 5,402,593 entitled "Safety Trigger For A Firearm" issued Apr. 4, 1995 and commonly assigned U.S. Pat. No. 5,386,659 entitled "Fire Control Mechanism For Semiautomatic Pistols" issued Feb. 7, 1995, both patents herein incorporated by reference in their entirety.

Still in reference to FIG. 1, the sear 15 is formed in a generally rectangular overall plate-like configuration and is preferably fabricated of steel coated with an electroless coating of a nickel phosphorous alloy with Teflon® particles, uniformly dispersed therein whereby the surfaces of the sear 15 will be characterized by its long wearing properties and a low coefficient of friction and inherent lubricity. The sear 15 further comprises, at its lower rear edge portion, a cam surface 22 disposed at an oblique angle with reference to the longitudinal axis of a slot 24 which provides for a path of movement for the sear 15. At its upper rear edge, the sear 15 is configured to provide a control surface 26 for engagement with a contact surface 30 of a depending leg 32 of the firing pin 34. A sear control plate 27 overlies the sear 15 and is provided with a sear driver pin 28 for mating engagement with the slot 24. During movement of the sear 15, the sear driver pin 28 guides the sear 15 in a consistently reproducible rectilinear manner along the longitudinal axis of the slot 24.

The contact surface 30 and the control surface 26 are oriented so as to be approximately parallel and abut one another along a common plane, seen on edge in FIG. 1 as a mating axis M. The mating axis M is approximately perpendicular to a firing axis F of the firing pin 34 at a time immediately preceding the firing of the handgun 2; that is, at a time when the firing pin 34 is tensioned by the firing spring 20, as is shown in FIG. 1. During the time that the contact surface 30 and the control surface 26 abut one another, an overlap of approximately several thousandths of an inch is typical, while an overlap of approximately 25 thousandths to approximately 50 thousandths of an inch is preferable.

In operation, the handgun 2 is fired by implementation of the trigger 10 in a conventional manner. As force is applied to the trigger 10, the trigger 10 rotates backwards and, through conventional interconnections as discussed above, causes a cam 36 to ride along the cam surface 22 of the sear 15. As the cam 36 rides along the cam surface 22, the sear 15 moves in a rectilinear manner along the slot 24 so as to displace the sear 15 from engagement with the depending leg 32. After disengagement with the control surface 26 of the sear 15, the firing spring 20 acts to advance the firing pin 34, including the depending leg 32, along the firing axis F in a direction towards a round of ammunition, subsequently impacting the round and firing the handgun 2.

The recoil that the handgun 2 experiences due to the firing of a round of ammunition ideally provides for the repositioning and re-tension of the firing pin 34. The force of the recoil acts to shift the slide 6 back along the firing axis F where an inclined surface 38 of the depending leg 32 contacts and rides along a ramp 40 of the sear 15. The force of the inclined surface 38 upon the ramp 40 displaces the sear 15 along the longitudinal axis of the slot 24 until such a time when the depending leg 32 has proceeded far enough backwards along the firing axis F to come out of contact with the ramp 40. At this time, the sear 15 is no longer downwardly biased by the force from the inclined surface 38 and so reasserts its engaging position through the action of an unillustrated sear spring. The control surface 26 subsequently engages the contact surface 30, placing the firing spring 20 under tension and the firing pin 34 once again at its ready position.

Although the foregoing description of the firing and resetting action of the handgun 2 depicted in FIG. 1 has been described as operating in its intended fashion, such operation may sometimes not occur. After discharge of a round of ammunition from the handgun 2, the recoil force propels the firing pin 34 backwards (and over the ramp 40 of the sear 15 while simultaneously compressing firing spring 20. At this time, the contact surface 30 should engage and become arrested by control surface 26 until the trigger 10 is once again squeezed. During this resetting motion of the firing pin 34, the rear portion of the firing pin 34, including the depending leg 32, is displaced upwards by a moment of force U generated by the recoil force. The majority of times this moment of force U causes no undesired side effects and the handgun 2 resets to a ready position as shown in FIG. 1.

Figure 2:
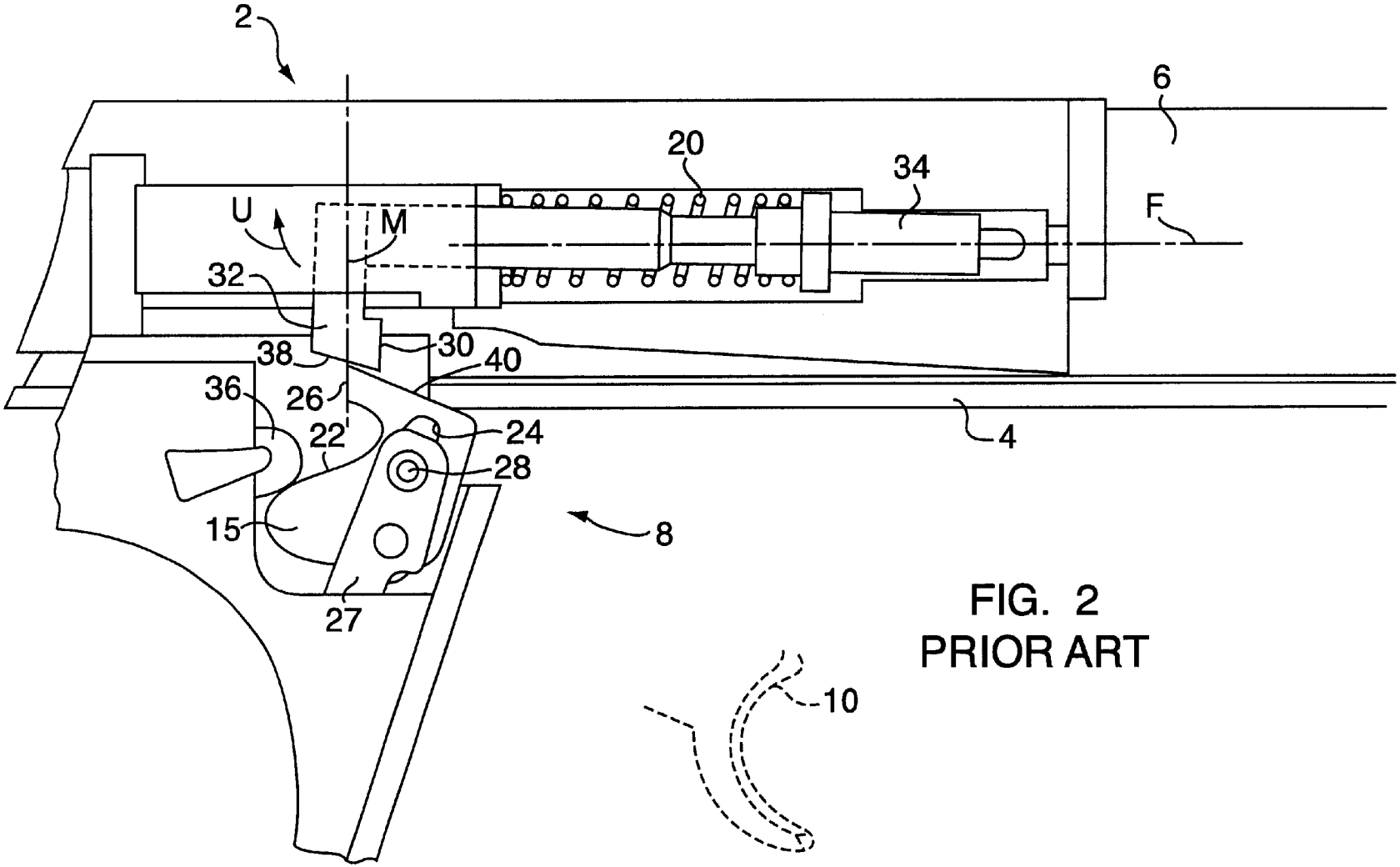
FIG. 2 PRIOR ART
FIG. 2 is a partial cross-sectional view of a prior art semiautomatic handgun according to FIG. 1 illustrating a fire pin override.

There are times, however, when the machining tolerances of the handgun 2, or when wear of the constituent elements of the handgun 2, are such that this moment of force U is enough to cause the contact surface 30 to 'hop' over the control surface 26, producing thereby unintended and potentially dangerous results. FIG. 2 illustrates the depending leg 32 of the firing pin 34 overriding the control surface 26 of the sear 15. If the contact surface 30 of the firing pin 34 overrides the control surface 26, one of two actions may subsequently transpire. The firing pin 34 may, under tension by the now compacted firing spring 20, repeat its advancement along the firing axis F until impacting another round of ammunition and causing an unintended discharge. In this case, the handgun 2 may fire more than one round with only a single squeezing of the trigger 10. Conversely, the contact surface 30 of the firing pin 34 may override the control surface 26 and, under tension by the now compacted firing spring 20, repeat its advancement along the firing axis F until impacting a second round of ammunition, but without enough force to cause discharge. In this second scenario, a second unintended discharge does not occur, however a subsequent, intentional automatic discharge is prohibited. Therefore, a user squeezing the trigger 10 will cause the sear 15 to move in its intended manner, but since the firing pin 34 would no longer be tensioned by the control surface 26, the handgun 2 would not discharge. The above-described problems associated with the arrangement of the prior art firing mechanism are only exacerbated by continued use of the handgun 2 and corresponding wear upon the contact surface 30 and the control surface 26.

The present invention operates so as to reduce the possibility of either unintended discharge or no discharge of a handgun due to the accidental disengagement of the contact surface 30 from the control surface 26. The present invention accomplishes these objectives in a manner which requires minimal re-engineering of the handgun 2, including taking into consideration machining tolerances and the effect of the recoil force on the firing pin 34. In particular, the beneficial aspects of the present invention operate without altering the design shape of either the cam 36 or the cam surface 22 of the sear 15.

Moreover, even after operational wear through repeated use of the handgun, the interlocked firing mechanism of the present invention provides for consistent engagement, and therefore consistent disengagement, of the firing pin of a handgun, thereby accommodating greater machining tolerances without compromising operational safety or functioning and, consequently, lowering manufacturing costs.

Figure 3:
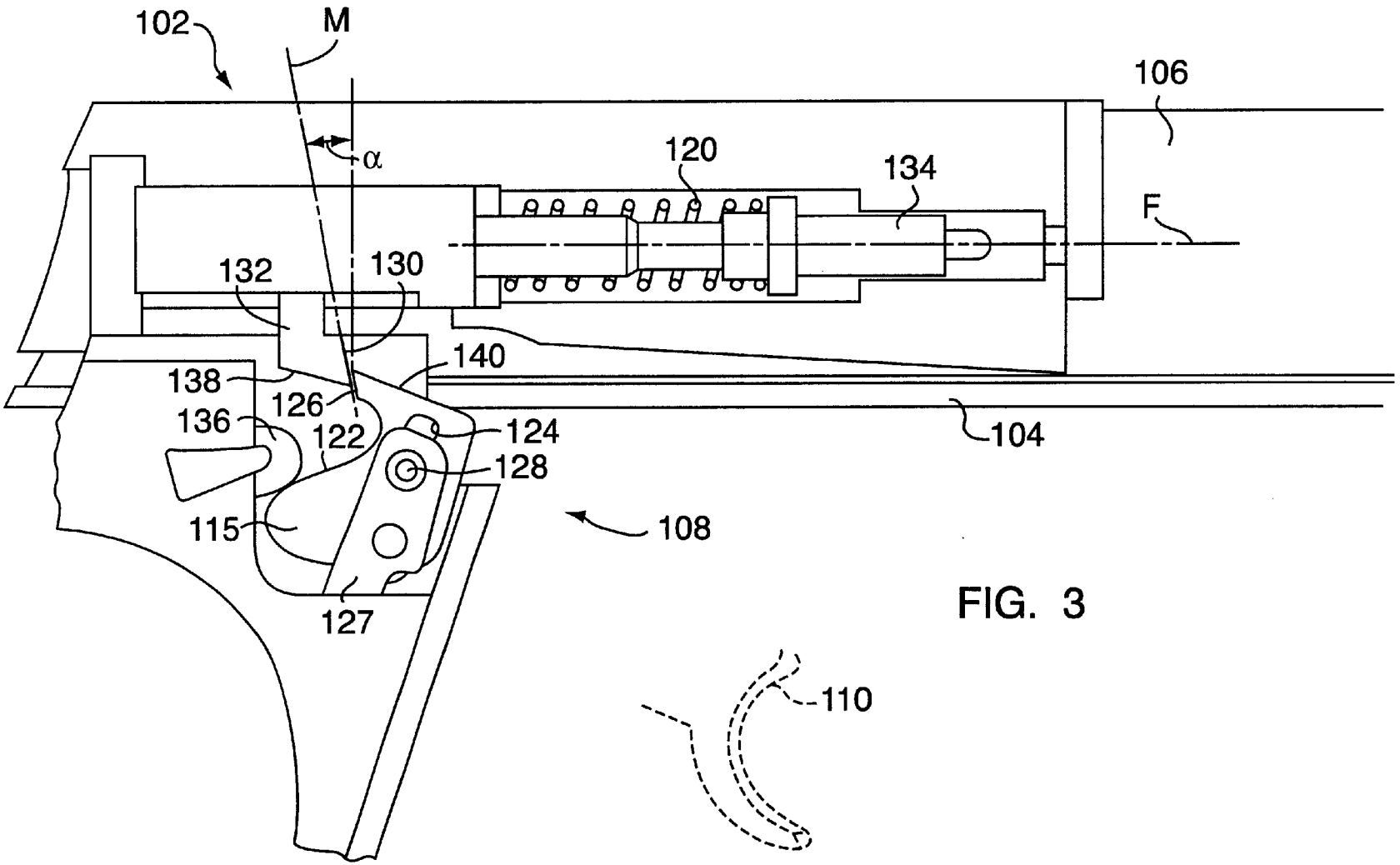
FIG. 3 is a partial cross-sectional view of a semiautomatic handgun of the type employing an angled interface between a sear and a depending leg of a firing pin, according to an embodiment of the present invention.

The present invention accomplishes these and other objectives by modifying the mating axis M with respect to the firing axis F of the firing pin 34. FIG. 3 illustrates a handgun 102 according to an embodiment of the present invention. Referring to FIG. 3, the semiautomatic pistol or handgun 102 comprises a high impact polymeric or metalized frame 104, a slide 106 and a fire control mechanism, designated generally by numeral 108.

Similar to the prior art handgun 2 shown in FIG. 1, the fire control mechanism 108 generally comprises a trigger 110 that pivots to initiate the firing of a round of ammunition from the handgun 102. The trigger 110 may be of unitary construction, as shown, or of a two-piece articulated construction. In either case, when one actuates the trigger 110 it will rotate and move rearward about a pivot point and, in a manner well known in the art, move a sear 115 sufficiently to cause the release of a firing spring 120 and thereby cause the handgun 102 to be fired, as will hereinafter be described in greater detail. Upon firing, recoil of the handgun 102 will enable repositioning of a firing pin 134 which will once again engage the sear 115 at a forward or "ready" position for the next firing cycle, a position as illustrated in FIG. 3. It will be readily apparent that the interconnections between the trigger 110 and the sear 115 during operation of the handgun 102 can be arranged in one of any number of conventional fashions, as discussed previously in connection with FIG. 1.

Referring once again to FIG. 3, the sear 115 is formed in a generally rectangular overall plate-like configuration and is preferably fabricated of steel coated with an electroless coating of a nickel phosphorous alloy with Teflon® particles, uniformly dispersed therein whereby the surfaces of the sear 115 will be characterized by its long wearing properties and a low coefficient of friction and inherent lubricity. The sear 115 further comprises, at its lower rear edge portion, a cam surface 122 disposed at an oblique angle with reference to the longitudinal axis of a slot 124 which provides for a path of movement for the sear 115. At its upper rear edge, the sear 115 is configured to provide a control surface 126 for engagement with a contact surface 130 of a depending leg 132 of the firing pin 134. A sear control plate 127 overlies the sear 115 and is provided with a sear driver pin 128 for mating engagement with the slot 124. During movement of the sear 115, the sear driver pin 128 guides the sear 115 in a consistently reproducible rectilinear manner along the longitudinal axis of the slot 124. During the time that the contact surface 130 and the control surface 126 abut one another, an overlap of approximately several thousandths of an inch is typical, while an overlap of approximately 25 thousandths to approximately 50 thousandths of an inch is preferable.

In operation, the handgun 102 is fired by implementation of the trigger 110 in a conventional manner. As force is applied to the trigger 110, the trigger 110 rotates backwards and, though conventional interconnections as discussed above, causes a cam 136 to ride along the cam surface 122 of the sear 115. As the cam 136 rides along the cam surface 122, the sear 115 moves in a rectilinear manner along the slot 124 so as to displace the sear 115 from engagement with the depending leg 132. After disengagement with the control surface 126 of the sear 115, the firing pin 134, including the depending leg 132, will be propelled along the firing axis F in a direction towards a round of ammunition, subsequently impacting the round and firing the handgun 102.

The recoil that the handgun 102 experiences due to the firing of a round of ammunition provides for the repositioning and re-tension of the firing pin 134. The force of the recoil acts to shift the slide 106 back along the firing axis F where an inclined surface 138 of the depending leg 132 contacts and rides along a ramp 140 of the sear 115. The force of the inclined surface 138 upon the ramp 140 pushes the sear 115 down the path of the slot 124 until such a time when the depending leg 132 has proceeded far enough backwards along the firing axis F to come out of contact with the ramp 140. At this time, the sear 115 is no longer downwardly biased by the force from the inclined surface 138 and so reasserts its engaging position through the action of an unillustrated sear spring. The control surface 126 subsequently re-engages the contact surface 130, and arrests the movement of the firing pin 134, thereby placing the firing spring 120 under tension and the firing pin 134 once again at its ready position.

Figure 4:
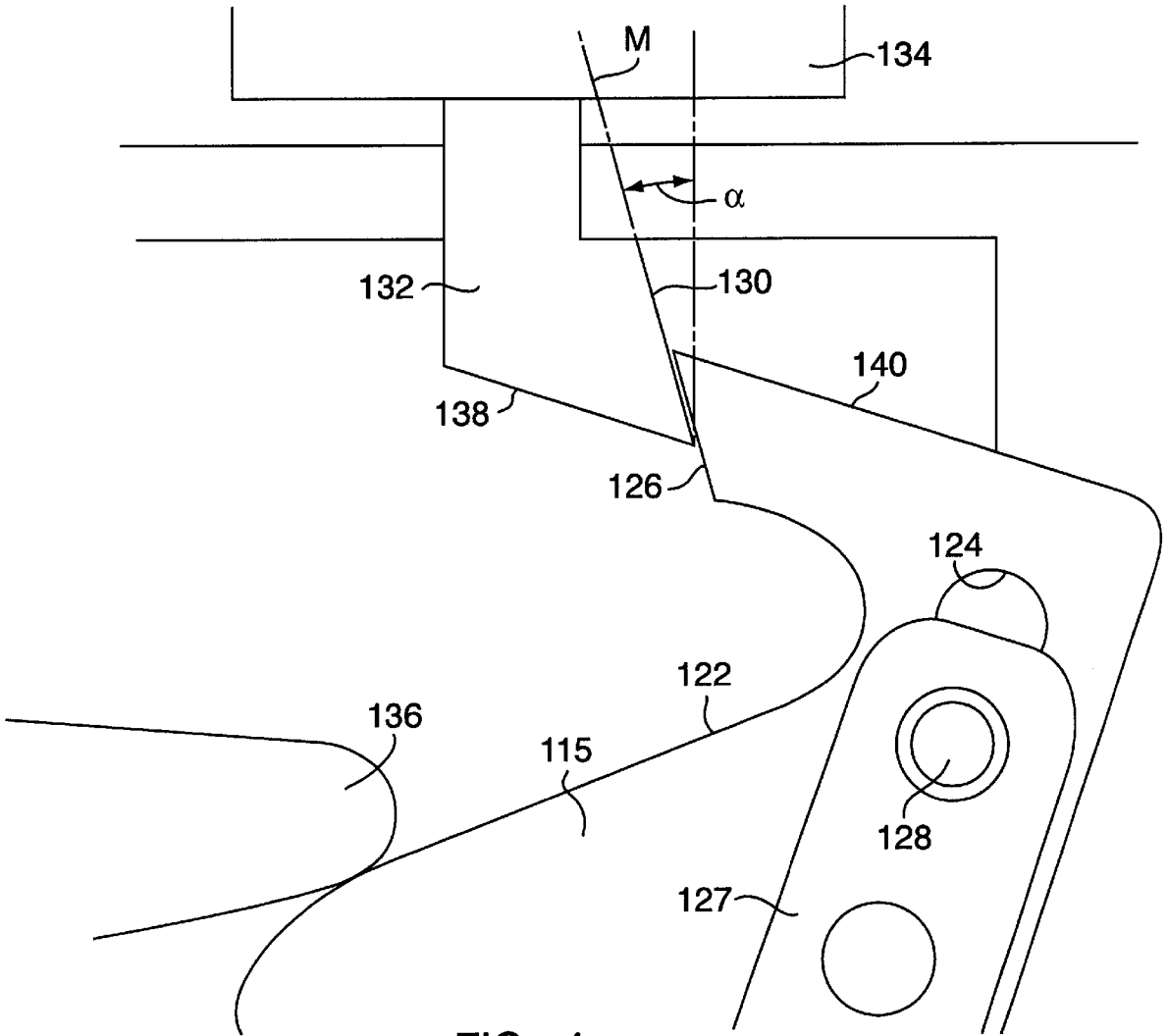
FIG. 4 is an enlarged view of the embodiment of FIG. 3 employing an angled interface between a sear and a depending leg of a firing pin.

The contact surface 130 and the control surface 126 are oriented so as to be approximately parallel and abut one another along a common plane, seen on edge in FIG. 3 as a mating axis M, however, in contrast to the arrangement of the prior art handgun 2 of FIG. 1, the mating axis M of the present embodiment is set at an angle a to a line approximately perpendicular to the firing axis F of the firing pin 134. FIG. 4 illustrates an enlarged view of the mating engagement between the contact surface 130 and the control surface 126 according to the embodiment as shown in FIG. 3. The angle a is preferably set to be approximately between 5° to 25°, and most preferably is set to be approximately 15°.

It has been discovered that by altering the mating axis M from being approximately perpendicular to the firing axis F, to instead being at a preferred angle a equal to approximately 150 from perpendicular, the incidence of the firing pin 134 hoping over the control surface 126, that is the erroneous override of the firing pin 134, can be substantially eliminated. In this manner, the advent of unintentional discharge, or no discharge at all, of the handgun 102 can be effectively avoided.

Moreover, as asserted previously, by changing the angle at which the contact surface 130 and the control surface 126 abut, there is no need to re-engineer other aspects of the handgun 102. Therefore, the shape and size of the cam 136 and the cam surface 122 may remain as previously designed while the movement of the sear 115 itself may also remain unchanged. While the angle a of the present invention has been described as being between approximately 5° to 25°, and most preferably is set to be approximately 15°, the present invention is not limited in this regard as alternative angles may also be substituted without departing from the broader aspects of the present invention. These alternative angles would be proportional to the magnitude of the vertical displacement of the rear portion of the firing pin 134 caused by the moment of force U generated by the recoil force, and therefore proportional to a distance D which, as seen in FIG. 3, is the perpendicular distance form the firing axis F to the mid-contact point of the contact surface 130 and the control surface 126.

The angled mating axis M also provides for more consistent engagement between the contact surface 130 and the control surface 126, which has the effect of providing for a correspondingly greater consistency in the disengagement of the contact surface 130 from the control surface 126. Therefore, during operation of the handgun 102, the feel of the trigger 110 when squeezed will be more consistent in subsequent discharges, as will the energy released by the firing spring 120. Further, the angled mating axis M allows for greater accommodation of variations in machining tolerances without compromising operational safety or functioning, thereby lowering manufacturing costs.

It will be readily apparent that, according to the embodiment as shown in FIGS. 3 and 4, the contact surface 130 and the control surface 126 need not overlap to a greater extent than those surfaces in the prior art embodiment of FIG. 1, but rather that it is the angle a between the contact surface 130 and the control surface 126 which itself substantially eliminates override of the firing pin 134 by drawing the contact surface 130 and the control surface 126 vertically into one another. Moreover, arranging the contact surface 130 and the control surface 126 in the manner as described in conjunction with the present invention compensates for operational wear of the firing mechanism 108 and thereby increases the usable life span of the handgun 102.

Although the present invention has been described in conjunction with semiautomatic handguns or pistols, the present invention is not limited in this regard as other types of firearms having similar firing mechanisms as does the handgun 102 may also experience the beneficial aspects of the present invention, through similar augmentation of the mating axis M, without departing from the broader aspects of the present invention.

Figure 5:
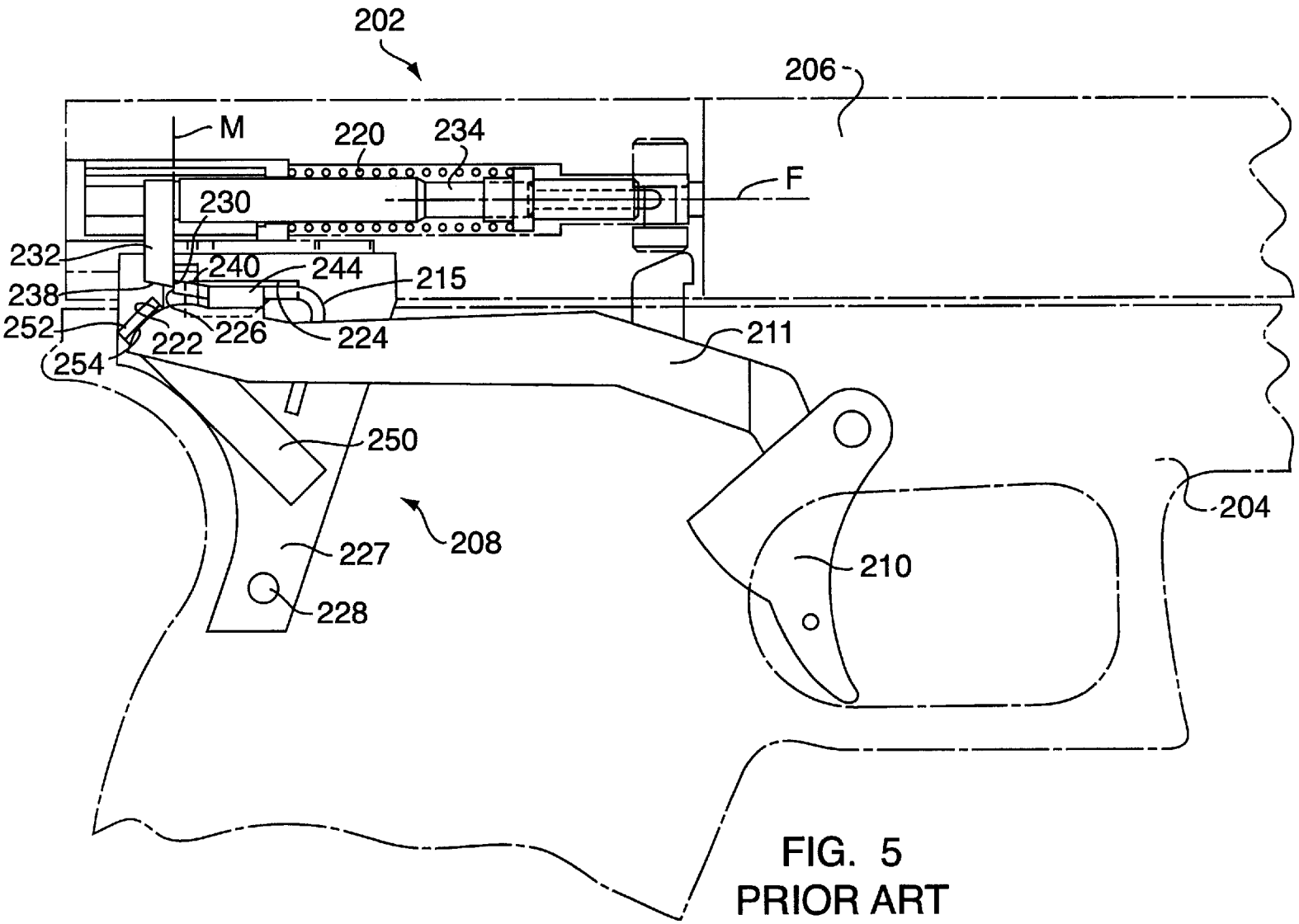
FIG. 5 PRIOR ART
FIG. 5 is a partial cross-sectional view of another prior art semiautomatic handgun having an alternative firing mechanism arrangement utilizing a non-angled interface control of a firing pin.

FIG. 5 illustrates one such prior art handgun 202, such as is manufactured by Glock® and described in U.S. Pat. No. 4,893,546 issued Jan. 16, 1990, generally comprising a high impact polymeric or metalized frame 204, a slide 206 and a firing mechanism, designated generally by numeral 208.

The firing mechanism 208 generally comprises a trigger 210 that pivots to initiate the firing of a round of ammunition from the handgun 202. The trigger 210 may be of unitary construction, as shown, or of a two-piece articulated construction. In either case, when one actuates the trigger 210 it will rotate and move rearward about a pivot point and, in a manner well known in the art, move a trigger slide 211 sufficiently to cause an abutment 215 to shift downwards, thereby releasing a firing spring 220 and producing the discharge of the handgun 202, as will hereinafter be described in greater detail. Upon firing, recoil of the handgun 202 will enable repositioning of a firing pin 234 which will once again engage the abutment 215 at a forward or "ready" position for the next firing cycle, a position as illustrated in FIG. 5. It will be readily apparent that the interconnections between the trigger 210 and the trigger arm 211 during operation of the handgun 202 can be arranged in one of any number of conventional fashions, the particular arrangement of these interconnections not being of primary concern with respect to the present invention. An example of a known interconnection can be found in previously cited U.S. Pat. No. 4,893,546 entitled "Automatic Pistol" issued Jan. 16, 1990.

Still in reference to FIG. 5, the trigger arm 211 further comprises, at a distal portion, a cam 222, as well as a bent arm 244 which protrudes into a cavity 224. The cavity 224 provides for a path of movement for the bent arm 244 which serves to selectively deflect an abutment 215. As can be better seen in the enlarged view of the firing mechanism 208 of FIG. 6, the abutment 215 is configured to provide a control surface 226 for engagement with a contact surface 230 of a nose 232 of the firing pin 234. An abutment control block 227 has formed therein the cavity 224 and is provided with a block pin 228 for attachment to the body of the handgun 202. A leaf spring 250 is integrally formed with the control block 227 and is adapted to have an extension 252 for providing a cam surface 254, against which the cam 222 selectively abuts.

Figure 6:
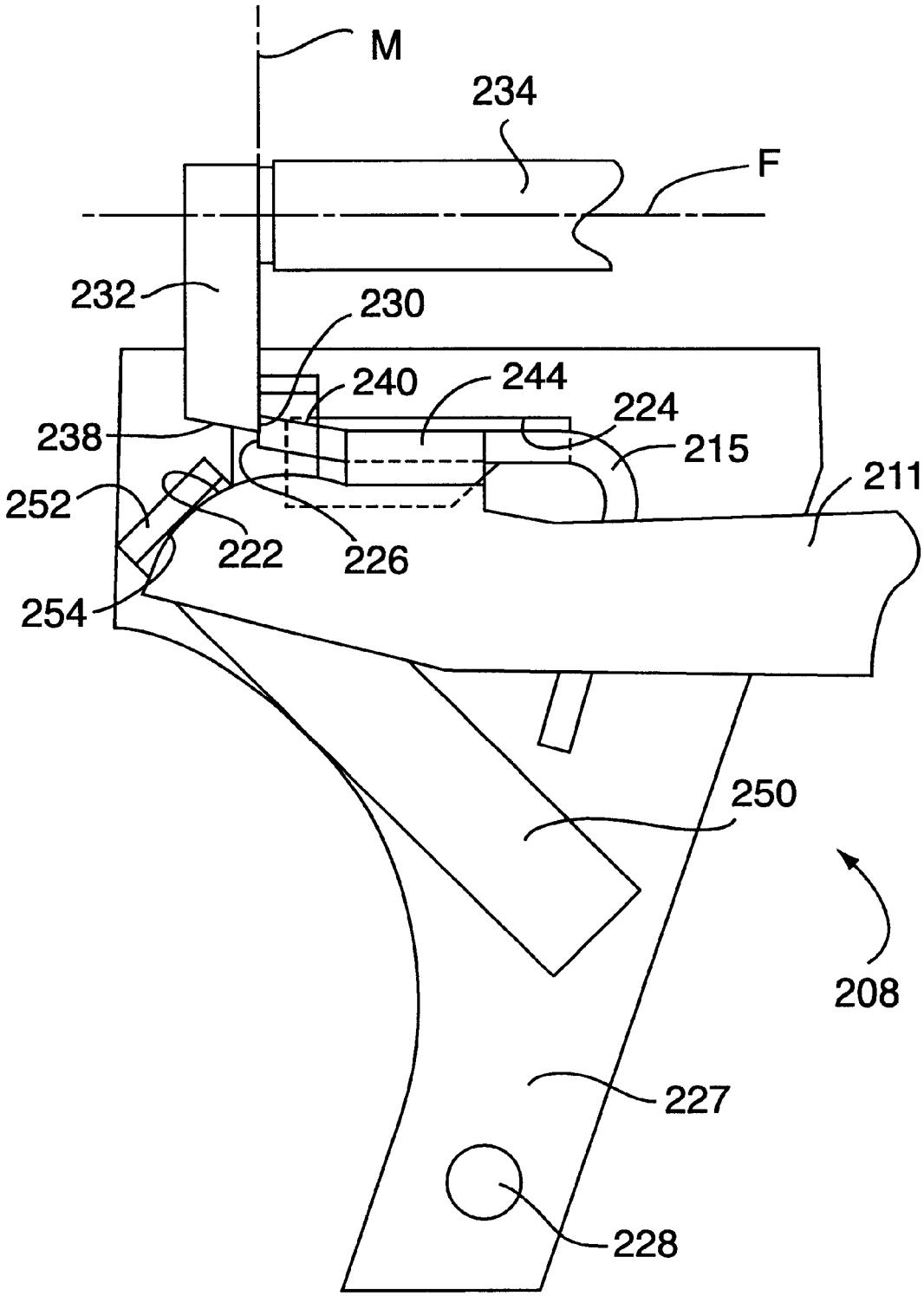
FIG. 6 PRIOR ART
FIG. 6 is an enlarged view of the firing mechanism according to the prior art handgun of FIG. 5.

The contact surface 230 and the control surface 226 are oriented so as to be approximately parallel and abut one another along a common plane, seen on edge in FIGS. 5–6 as a mating axis M. The mating axis M is approximately perpendicular to a firing axis F of the firing pin 234 at a time immediately preceding the firing of the handgun 202; that is, at a time when the firing pin 234 is tensioned by the firing spring 220, as is shown in FIG. 5. During the time that the contact surface 230 and the control surface 226 abut one another, an overlap of approximately 9 thousandths of an inch is typical.

Figure 7:
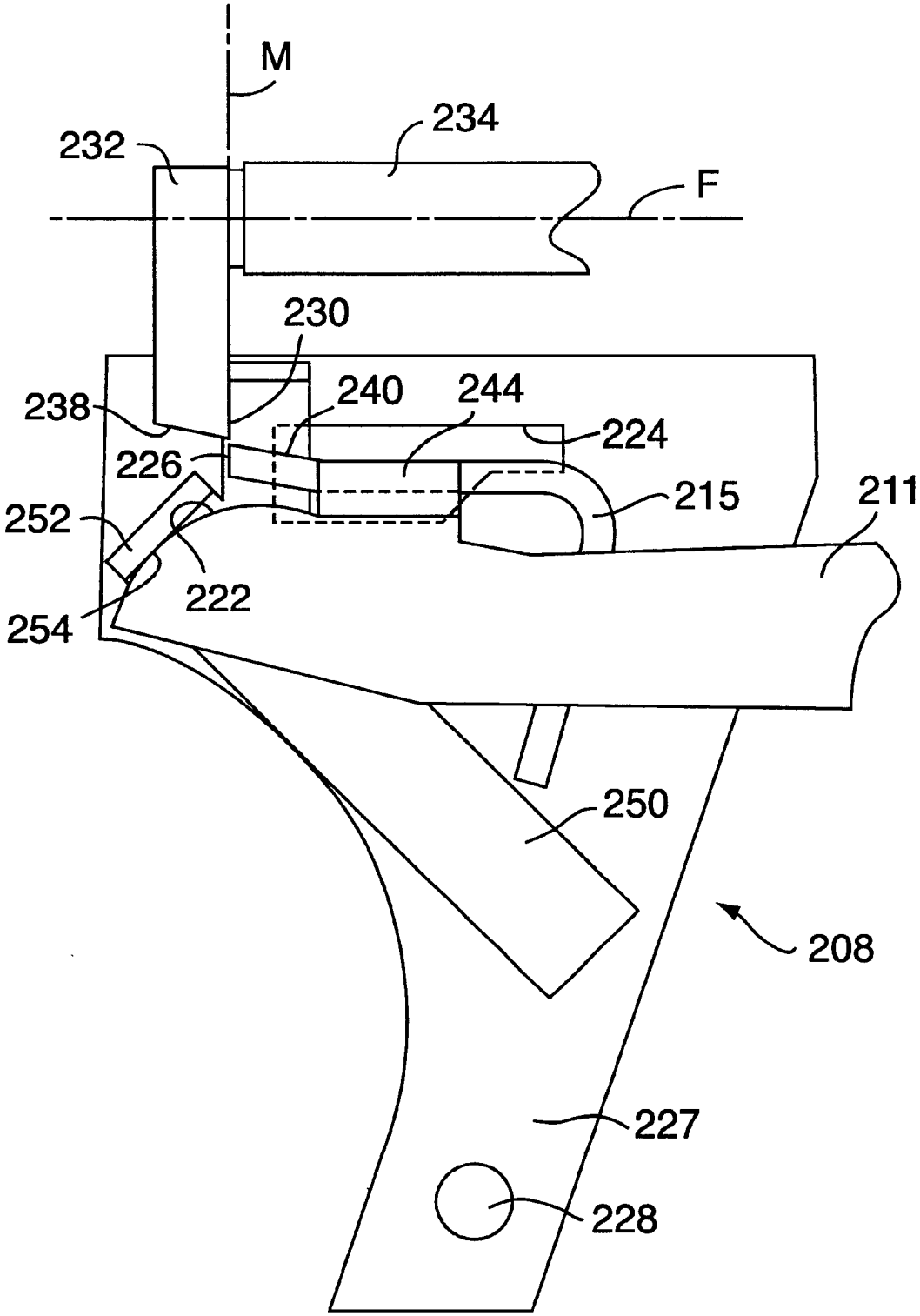
FIG. 7 PRIOR ART
FIG. 7 is a enlarged view of the firing mechanism according to the prior art handgun of FIG. 5 illustrating disengagement of the firing mechanism.

In operation, the handgun 202 is fired by implementation of the trigger 210 in a conventional manner. As force is applied to the trigger 210, the trigger 210 rotates backwards and, through the rectilinear movement of the trigger slide 211, causes the cam 222 to ride along the cam surface 254 of the extension 252. As the cam 222 rides along the cam surface 254, the bent arm 244 is displaced downwards so as to disengage the abutment 215 from engagement with the nose 232, as can be seen in FIG. 7. After disengagement with the control surface 226 of the abutment 215, the firing spring 220 acts to advance the firing pin 234, including the nose 232, along the firing axis F in a direction towards a round of ammunition, subsequently impacting the round and firing the handgun 202.

The recoil that the handgun 202 experiences due to the firing of a round of ammunition ideally provides for the repositioning and retension of the firing pin 234. The force of the recoil acts to shift the slide 206 back along the firing axis F where an inclined surface 238 of the nose 232 contacts and rides along a ramp 240 of the abutment 215. The control surface 226 subsequently re-engages the contact surface 230, placing the firing spring 220 under tension and the firing pin 234 once again at its ready position.

As was discussed in conjunction with FIGS. 1 and 2, the foregoing description of the firing and resetting action of the handgun 202 depicted in FIGS. 5–7 may sometimes not occur. After discharge of a round of ammunition from the handgun 202, the recoil force propels the firing pin 234 backwards while simultaneously compressing firing spring 220. At this time, the contact surface 230 should re-engage and become arrested by control surface 226 until the trigger 210 is once again squeezed.

It should be readily apparent that during the resetting motion of the firing pin 234, the recoil force acts to displace the rear portion of the firing pin 234, including the nose 232, upwards by a moment of force U, as previously depicted in FIG. 2. Although not consistently a problem, there are times when the machining tolerances of the handgun 202, or when wear of the constituent elements of the handgun 202, are such that this moment of force U is enough to cause the contact surface 230 to 'hop' over the control surface 226, producing thereby unintended and potentially dangerous results.

Similar to the problems associated with the prior art arrangement as shown in FIGS. 1 and 2, if the contact surface 230 of the firing pin 234 overrides the control surface 226, one of two actions may subsequently transpire. The firing pin 234 may, under tension by the now compacted firing spring 220, repeat its advancement along the firing axis F until impacting another round of ammunition and causing an unintended discharge. In this case, the handgun 202 may fire more than one round with only a single squeezing of the trigger 210.

Conversely, the contact surface 230 of the firing pin 234 may override the control surface 226 and, under tension by the now compacted firing spring 220, repeat its advancement along the firing axis F until impacting a second round of ammunition, but without enough force to cause discharge. In this second scenario, a second unintended discharge does not occur, however a subsequent, intentional automatic discharge is prohibited. Therefore, a user squeezing the trigger 210 will cause the abutment 215 to move in its intended manner, but since the firing pin 234 would no longer be tensioned by the control surface 226, the handgun 202 would not discharge. The above-described problems associated with the arrangement of the prior art firing mechanism shown in FIGS. 5–7 are only exacerbated by continued use of the handgun 202 and corresponding wear upon the contact surface 230 and the control surface 226.

Figure 8:
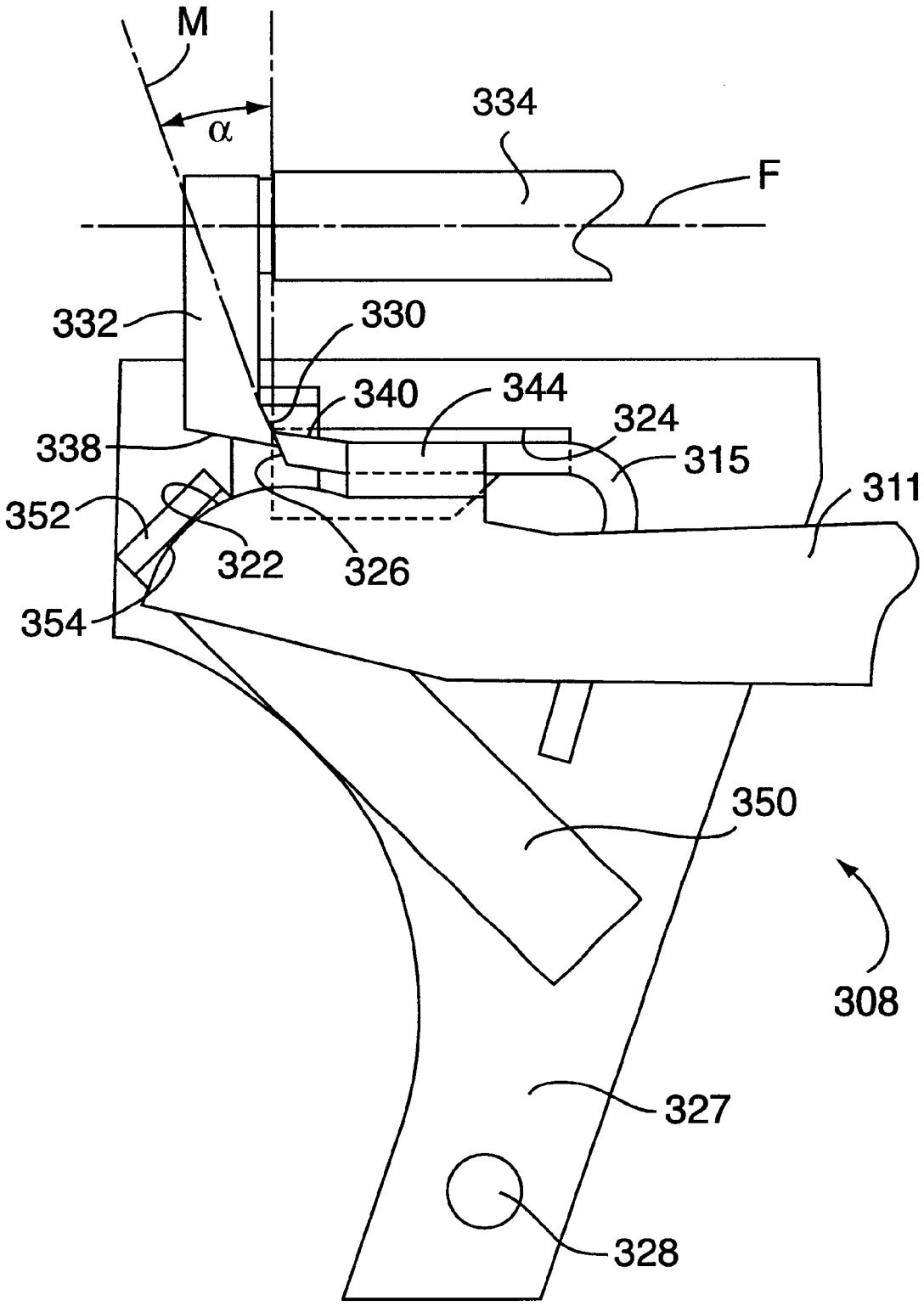
FIG. 8 is an enlarged view of another embodiment of the present invention, integrating an angled interface with the firing mechanism of FIG. 5.

The prior art firing mechanism 208 illustrated in FIGS. 5–7 may be augmented in a manner consistent with the previous embodiment depicted in FIGS. 3 and 4. As is illustrated in FIG. 8, a contact surface 330 and a control surface 326 are oriented so as to be approximately parallel and abut one another along a common plane, seen on edge in FIG. 8 as a mating axis M, however, in contrast to the arrangement of the prior art handgun 202 of FIGS. 5–7, the mating axis M of the present embodiment is set at an angle a to a line approximately perpendicular to the firing axis F of the firing pin 334. The angle a is preferably set to be approximately between 5° to 25°, and most preferably is set to be approximately 15°.

It has been discovered that by altering the mating axis M from being approximately perpendicular to the firing axis F, to instead being at a preferred angle a equal to approximately 15° from perpendicular, the incidence of the firing pin 334 hoping over the control surface 326, that is the erroneous override of the firing pin 334, can be substantially eliminated. In this manner the advent of unintentional discharge, or no discharge at all, of the firing mechanism 308 can be effectively avoided. It will be readily apparent that the additional benefits enjoyed by the embodiment illustrated in FIGS. 3–4 would likewise be realized in the firing mechanism 308 shown in FIG. 8.

Although FIGS. 3, 4 and 8 have described two embodiments of the present invention, it will be readily apparent that the beneficial aspects of the present invention may be realized in any gun configuration which incorporates a firing pin mechanism.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. An interlocked firing mechanism for a gun including a trigger, a rotatable sear and a firing pin having a depending leg and being movable in a rectilinear manner along a firing axis, said interlocked firing mechanism comprising:

said depending leg is adapted to have a contact surface;

said sear is adapted to have a control surface in mating engagement with said contact surface at a time prior to said firing pin being released to initiate forward movement of said firing pin, said sear rotating in a first direction to initiate said forward movement of said firing pin;

said contact surface and said control surface are adapted to have parallel surfaces which contact one another along a mating plane wherein an edge of said mating plane defines a mating axis; and wherein said mating axis is set at a predetermined angle from a line perpendicular to said firing axis, said acute angle sweeping in said first direction from said line perpendicular to said firing axis.

2. The interlocked firing mechanism for a gun including a trigger, a sear and a firing pin having a depending leg and being movable in a rectilinear manner along a firing axis according to claim 1, further comprising:

said predetermined angle is between approximately 5° to approximately 25°.

3. The interlocked firing mechanism for a gun including a trigger, a sear and a firing pin having a depending leg and being movable in a rectilinear manner along a firing axis according to claim 2, further comprising:

said predetermined angle is approximately 15°.

4. A method of providing an interlocked firing mechanism for a gun including a trigger, a rotatable sear and a firing pin having a depending leg and being movable in a rectilinear manner along a firing axis, said method comprising the steps of:

forming a contact surface on said depending leg;

forming a control surface on said sear for mating engagement with said contact surface at a time prior to said firing pin being released to initiate forward movement of said firing pin, said sear rotating in a first direction to initiate said forward movement of said firing pin;

adapting said contact surface and said control surface to have parallel surfaces which contact one another along a mating plane wherein an edge of said mating plane defines a mating axis; and orienting said mating axis at a predetermined acute angle from a line perpendicular to said firing axis, said acute angle sweeping in said first direction from said line perpendicular to said firing axis.

5. The method of providing an interlocked firing mechanism for a gun including a trigger, a sear and a firing pin having a depending leg and being movable in a rectilinear manner along a firing axis according to claim 4, further comprising the steps of:

orienting said predetermined angle to be between approximately 5° to approximately 25°.

6. The method of providing an interlocked firing mechanism for a gun including a trigger, a sear and a firing pin having a depending leg and being movable in a rectilinear manner along a firing axis according to claim 5, further comprising the steps of:

orienting said predetermined angle to be approximately 15°.

* * * * *

UNITED STATES PATENT AND TRADEMARK OFFICE

CERTIFICATE OF CORRECTION

PATENT NO. : 6,308,448 B1
DATED : October 30, 2001
INVENTOR(S) : John Kapusta et al.

It is certified that error appears in the above-identified patent and that said Letters Patent is hereby corrected as shown below:

Column 10,
Line 35, after "at a predetermined", please insert -- acute --.

Signed and Sealed this

Sixth Day of August, 2002

*Attest:*

*Attesting Officer*

JAMES E. ROGAN
*Director of the United States Patent and Trademark Office*